United States Patent [19]

Tepera

[11] Patent Number: 4,761,930

[45] Date of Patent: Aug. 9, 1988

[54] GRATING SYSTEM

[75] Inventor: Joseph E. Tepera, McKinney, Tex.

[73] Assignee: Fibergrate Corporation, Dallas, Tex.

[21] Appl. No.: 330,700

[22] Filed: Dec. 14, 1981

[51] Int. Cl.[4] ..... E04C 2/42

[52] U.S. Cl. ..... 52/669; 52/664; 52/666; 52/668

[58] Field of Search ..... 52/669, 177, 181, 664, 52/665, 666, 668

[56] References Cited

U.S. PATENT DOCUMENTS

| | | | |
|---|---|---|---|
| 1,005,012 | 10/1911 | Forsyth | 52/664 |
| 1,024,001 | 4/1912 | Forsyth | 52/668 |
| 1,214,928 | 2/1917 | Lachman | 52/668 |
| 2,645,985 | 7/1953 | Beebe et al. | 52/669 |
| 3,540,178 | 11/1970 | Altissimo | 52/669 |
| 3,948,013 | 4/1976 | Lobaugh et al. | 52/669 |
| 4,051,639 | 10/1977 | Lombardi et al. | 52/177 |
| 4,112,640 | 9/1978 | Reifsnyder | 52/177 |
| 4,126,980 | 11/1978 | Parsons | 52/669 |

FOREIGN PATENT DOCUMENTS

| | | | |
|---|---|---|---|
| 2009026 | 11/1971 | Fed. Rep. of Germany | 52/668 |

*Primary Examiner*—Carl D. Friedman
*Assistant Examiner*—Michael Safavi
*Attorney, Agent, or Firm*—Richards, Harris, Medlock & Andrews

[57] ABSTRACT

An interlock grate structure is provided which includes longitudinal load bearing span bars having lateral locating slots spaced therealong for receiving transverse tie bars and transverse tie bars having axial locking means which engage the longitudinal span bar at the point of juncture and prevent axial displacement of the tie bar relative to the span bar. A longitudinal interlock member serves to interlock the position of the transverse tie bar locking means with respect to the longitudinal span bar and in some instances provides added structural support.

4 Claims, 3 Drawing Sheets

GRATING SYSTEM

BACKGROUND ART

The present invention relates to the fabrication of load bearing grate articles typically employed in commercial and industrial floor, platform and step construction, for example. In another aspect, the present invention relates to a three-piece grating system wherein grate structures of load bearing capacity can be efficiently constructed to order in an interlocking fashion which provides improved structural integrity as compared to multi-piece grate articles which have heretofore been available. In a still further aspect, this invention relates to a method of construction for producing grating articles from individual components which results in improved structural integrity of the grating as a result of the interaction of the components as assembled.

Load bearing grate structures, i.e. structures comprising longitudinal span bars fabricated to support commercial and industrial loads tied together with transverse tie bars, have been conventionally produced from a variety of materials including wood, metals such as steel or aluminum, etc., and more recently, plastic materials particularly fiber reinforced plastic resins. In the latter case, "one-piece" grating materials have been fabricated wherein the longitudinal span bars and transverse tie bars are formed integrally during the molding process. In more conventional grating articles however, the longitudinal span bars must be assembled, usually in parallel, using the transverse tie bars. In the past this assembly has been effected through use of welds or bonding materials as was appropriate for the particular materials from which the grate was being fabricated. In addition to such bonding at the juncture between longitudinal span bar and transverse tie bar members, metal stakes and pins have been driven through the span bars and into the tie bars at the juncture therebetween to form a mechanical bond therebetween. More recently, thermoplastic spacers in the form of a sleeve over the tie bars have been used in order to maintain spacing between longitudinal span bars. These prior art methods in addition to being time consuming from a fabrication standpoint have other drawbacks. For example, the use of metal stakes or pins to form mechanical connection between span bars and tie bars produces a fracture of the material through which they and driven at precisely the point in the structure where maximum stress occurs under load. Thermoplastic spacers avoid this problem but are subject to deformation thereby allowing shifts in the relationship between span bar and tie bar to occur under load. Further, when the grating structure is applied during construction, the use of such spacers becomes disadvantageous since the cutting of an aperture through the grate structure or other shaping of the sides of the grate structure allow the spacers to dislodge from their positions on the tie bars thus abrogating their effectiveness as mechanical locators for the span bar-tie bar intersection.

Thus, a more economical and efficient means for effecting a mechanical lock between tie bars and longitudinal span bars in grating articles is desirable.

SUMMARY OF THE INVENTION

According to the present invention, load bearing grate structures are provided which are easily fabricated from three separate types of pieces and which provide excellent durability and load bearing capabilities due to an improved mechanical joining between longitudinal span bar and transverse tie bar. Thus, the structures of the present invention generally can be fabricated from three separate pieces which interact to attain the benefits noted above. The term "three piece" as used herein will be understood to refer to three components which interact and assemble in the manner disclosed herein below. It is further to be understood however that each or any of the "pieces" may itself be formed from a multiple of parts or sections. The first such piece is a longitudinal span bar suitably constructed for the purpose of bearing the major load stresses which will be placed on the article during use. The longitudinal span bar structures include lateral locating slots spaced therealong at a preselected distance dictating the interval at which connecting tie bars will be used in the particular structure. The second piece of the construction is the transverse tie bar which includes an axial locking means spaced therealong at a predetermined distance which will determine the width between longitudinal span bars for the particular grate article being fabricated. The axial locking means on the transverse tie bars are formed so as to engage the lateral slots in the longitudinal span bars in a manner so as to prevent axial displacement of the transverse tie bar with respect to each of the longitudinal span bars that the tie bars interconnect. This forms an interlock which provides enhanced stability to the longitudinal span bars. Finally, the third piece of the construction comprises a longitudinal interlock member which closes the open end of the locating slots of the longitudinal span bar and thereby holds the axial locking means of the tie bars in engagement with the locating slots.

The grating articles of the present invention which can be fabricated from wood, metals or in a preferred embodiment, fiber reinforced plastic resin materials provide for a mechanically interlocked span bar-tie bar intersection, can be produced in a variety of configurations, and are relatively easy to assemble.

In a preferred embodiment of the grating structure of the present invention, the interlock member is equal in length to the longitudinal span bars being employed and comprises a locating slot which engages the axial locking means of the transverse tie bars thereby, in effect, providing a two-piece longitudinal span bar which not only locks the transverse tie bar in place but also allows the transverse tie bar to mechanically restrict relative longitudinal motion between the span bar and elongated longitudinal interlock member thereby providing increased structural integrity to the entire structure.

DETAILED DESCRIPTION

Figure 1:
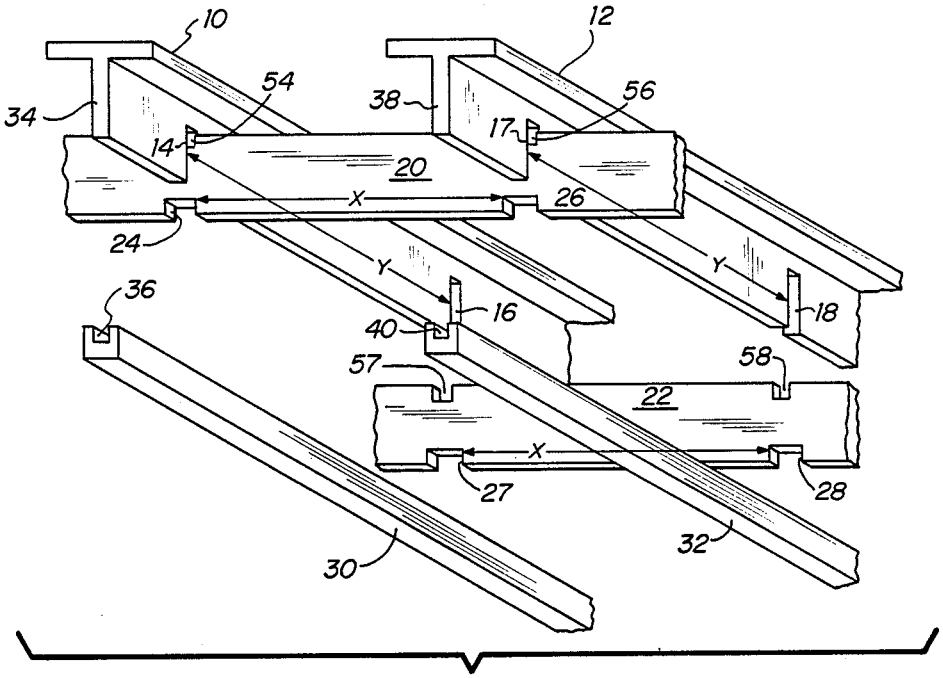
FIG. 1 is a perspective view of one embodiment of grate structures of the present invention shown in an aligned but disassembled fashion.

Grating structures of the present invention are easy to assemble, provide positive mechanical interlock of the junction between span bars and tie bars without a reduction in mechanical strength caused by the use of retaining fasteners or pins and without the need for the use of additional spacers, can be fabricated from a variety of materials and lend themselves to either mechanized or manual fabrication techniques. Because the cross section of the three separate types of pieces which are used to construct the grate structure are substantially constant (except for locking slots and/or grooves as described further hereinbelow) fabrication by pultrusion techniques is possible. These techniques are especially useful when the material being employed is fiber reinforced plastic resin material. Thus, by using a suitable mixture of thermosetting plastic resin materials materials, for example a mixture of polyester resins, styrenemonomer solvent and filler materials, in combination with a catalyst, employed with glass fibers, pultrusion of the three pieces necessary to form the grating system can be effected economically while obtaining the excellent corrosion resistence, non-conductivity and durability characteristics of structures formed from such materials. It will be understood that while fiber reinforced plastic resin materials are one preferred material for use in fabrication of the grating articles of the present invention, other materials such as wood, composites, metals, etc., and combinations of these materials with plastics are also contemplated depending upon the strength and environmental requirements of the particular application.

The first of the three construction pieces of the grating system of the present invention are longitudinal span bars which are sometimes referred to as load bearing bars in that their cross-sectional configuration is designed with the loads which are to be imposed upon the grating structure in mind. The span bars of the grating articles of the present invention, regardless of cross-sectional configuration, comprise lateral locating slots through which pass the transverse tie bars further described hereinbelow. The locating slots can be of a variety of configurations, as depicted in the drawings, but the slots will always be open ended so that during assembly the transverse tie bars can be fitted to the slots with a vertical motion as opposed to the axial placement which is required when apertures rather than slots are employed, such as is the case in some prior art structures. Thus, the use of slots is highly advantageous from a construction standpoint since a series of longitudinal span bars can be tied together with the transverse tie bars by simply laying the span bars in parallel at the desired parallel spacing and then inserting, through use of vertical motion, transverse tie bars so as to fix that relationship.

The transverse tie bars of the grating system, while certainly adding to the structural characteristics of the grate structure, do not normally bear the major portion of the load which the structure is designed to bear. However, one feature of the present invention is that the interlock grate system provides for the possibility of designing the transverse tie bars to bear a significant portion of the load. In such an embodiment, both longitudinal span bars and transverse tie bars would share a significant portion of the load placed on the grate. However, where the major portion of the load is to be born by the longitudinal span bars, the main function of the transverse tie bars is to fix the parallel relationship between the longitudinal span bars. While the transverse tie bars can have various cross-sectional configurations, as exemplified by the drawings, in each case the tie bars will comprise axial locking means spaced along the length thereof for engaging the locating slots of the longitudinal span bars to prevent axial displacement of the tie bar once it is in place in the grate structure. The axial locking means can either take the form of a slot or a raised portion of material and can be designed either to engage the lateral locating slots of the span bars or the longitudinal interlock member further described hereinbelow.

The longitudinal interlock piece of the three-piece grate structure of the present invention serves to close the open end of the locating slots of the longitudinal span bars and thereby interlock the axial locking means of the transverse tie bar so as to form a tie bar-span bar junction which restricts axial motion of the tie bars. The longitudinal interlock member can be joined to the other two pieces using vertical motion thereby facilitating easy fabrication either mechanically or manually. The longitudinal interlock member can either serve to hold the axial locking means of the transverse tie bar in engagement with the locating slot of the longitudinal span bar or can itself engage the locking means. In the preferred embodiment of the present invention, the longitudinal interlock member is equal in length to the span bar members being fabricated so that the span bars, in effect, become reinforced by the presence of the interlock member affixed thereto along the entire length thereof. In this connection, it will be understood that in some instances the longitudinal interlock member will be fabricated so as to perform a primary load bearing function when bonded to the longitudinal span bar and actually becomes a significant load bearing portion thereof. In other instances, the longitudinal interlock member, while providing some load bearing support, will serve mainly the functions specified above with respect to fixing the structural relationship of the tie bar-span bar intersection. Finally, in a particularly preferred embodiment of the present invention, the longitudinal interlock members can themselves comprise lateral locating slots spaced therealong which engage the axial locking means of the transverse tie bars. This engagement fixes the relationship of the longitudinal interlock member to the longitudinal span bar. Thus, any tendency for slip or displacement to occur between the span bar and longitudinal interlock member when the span bar is placed under load will be reduced by the mechanical interlock of all three pieces.

Further, the interlock grate system of the present invention provides a means for assembling a prestressed grate, that is, one with an upward bow, which upon loading will deflect to a flat plane. This can be accomplished by adjusting the spacing between lateral locating slots on the longitudinal span bars and the axial locking means of the transverse tie bars, taking into account the deflection properties of the materials being employed, to form a bowed grate structure.

Referring to FIG. 1, a first embodiment of the grate structures of the present invention is depicted in an unassembled but aligned form. As depicted, longitudinal span bars 10 and 12 are of a "T" cross-section so as to take advantage of the well known strength of this configuration for a load bearing beam type structure. Transverse tie bars 20 and 22 are of a generally rectangular cross-section. Longitudinal interlock members 30 and 32 are of a generally channel or U-shaped cross-section.

Span bar 10 has lateral locating slots 14 and 16 and span bar 12 has lateral locating slots 17 and 18 which are of generally rectangular configuration and are open ended. Both lateral locating slots 14 and 16 are spaced along span bar 10 at a distance Y and lateral locating slots 17 and 18 are similarly spaced along span bar 12 for a distance Y, the distance Y thus fixing the interval at which tie bars 20 and 22 will connect span bars 10 and 12.

Tie bar 20 has two sets of locking notches 24, 54 and 26, 56 which provide the axial locking feature for this particular embodiment. Similarly, tie bar 22 has locking notch sets 27, 57 and 28, 58 all of the locking notches having a generally open ended rectangular configuration. Upper locking notches 54, 56, 57 and 58 are sized so as to engage those portions of span bars 10 and 12 directly above the lateral locating slots thereof upon assembly. Lower locking notches 24, 26, 27 and 28 are sized so as to engage interlock member 30 and 32 as described below. Thus, to assemble span bars 10 and 12 to tie bars 20 and 22, pieces may be moved vertically into engagement, a distance Y between lateral locating slots fixing the longitudinal distance between tie bars and the distance X between locking notches fixing the parallel distance between span bars 10 and 12.

To complete assembly of the grate structure depicted in FIG. 1, interlock members 30 and 32 can be vertically placed into position such that the lower portion 34 of tie bar 10 becomes seated in the channel 36 of interlock member 30 and the lower portion 38 of span bar 12 becomes seated in the channel 40 of interlock member 32. Thus, the interlock members 30 and 32 once either bonded or mechanically fitted to the lower portions of span bars 10 and 12 (as further described hereinbelow), serve to lock in engagement locking notches 24, 26, 27 and 28 in their position in lateral locating slots 14, 16, 17 and 18.

Figure 2:
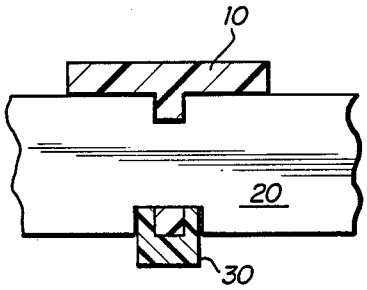
FIG. 2 is a cross-sectional view of a span bar-tie bar intersection showing two alternate arrangements for engagement of the interlock members.
Figure 2B:
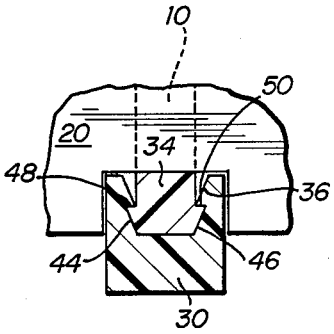
Figure 2A:
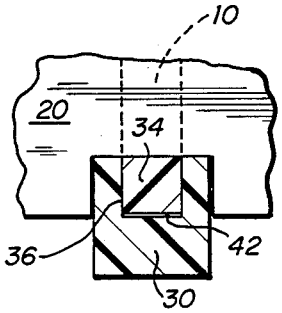

Referring to FIG. 2, a more detailed view of the tie bar-span bar junction of the grating structure of FIG. 1 is depicted. In FIG. 2, span bar 10, tie bar 20 and interlock member 30 are shown in an assembled condition. In FIG. 2A, a magnified view of lower portion 34 of span bar 10 is shown in a seated engagement with channel 36 of interlock member 30, bonding material 42 serves to secure interlock member 30 substantially along the entire length of span bar 10. In addition to the use of bonding material the interface of lower portion 34 with channel 36 could be welded. FIG. 2B illustrates one possible modification of the grating structure depicted in FIG. 1 wherein the lower portion 34 of span bar 10 is supplied with flanges 44 and 46 and interlock member 30 comprises a recessed or undercut portions 48 and 50 in channel 36 so as to provide a snap-fit relationship for the interlock member on lower portion 34. Depending upon the materials employed to fabricate the grate structure a combination of the mechanical locking system of FIG. 2B and the weld or bonding system of 2A could be employed.

Figure 3:
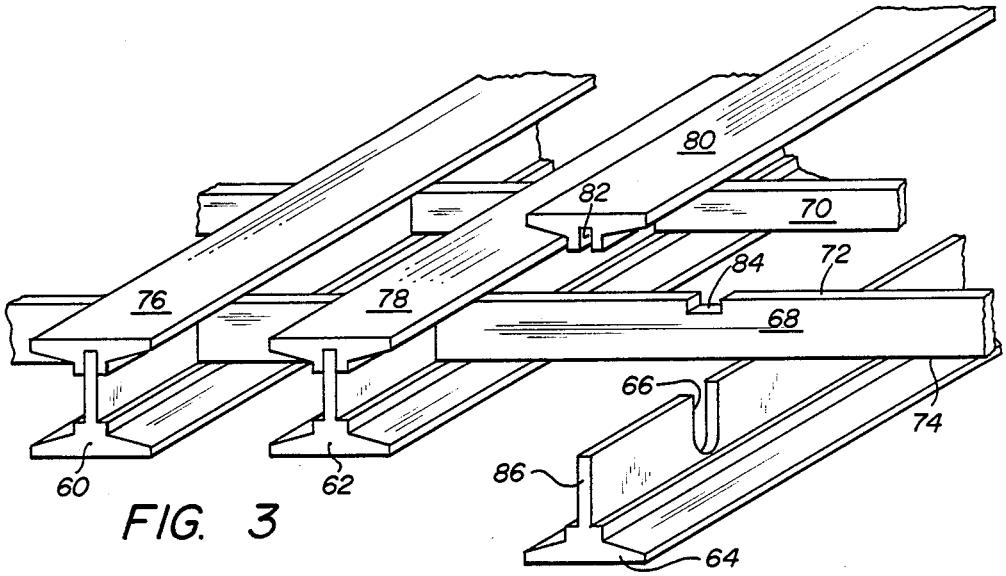
FIG. 3 is a perspective view of a second embodiment of a grate structure of the present invention shown in partial blown apart relation.

Referring to FIG. 3, a second embodiment of a grate structure of the present invention is shown wherein portions of two of the span bars 60 and 62 are shown in a constructed condition with a third span bar 64 shown disassembled for purposes of illustration. In this embodiment of the present invention, the lateral locating slots, such as slot 66 on span bar 64, are of a generally U-shaped configuration while the span bars 60, 62 and 64 are of a modified T cross-section. Tie bars 68 and 70 have an upper flat surface 72 (as depicted on tie bar 68) and a lower rounded surface 74 fabricated so as to fit snugly in U-shaped lateral locating slot 66. Interlock members 76, 78 and 80 are of an abbreviated T cross-section and comprise channel 82 (as shown on interlock member 80 such that when assembled interlock members 76, 78 and 80) cooperate with longitudinal span bar members 60, 62 and 64 to form a generally I-beam shaped load bearing member. Thus, in the embodiment of the invention depicted in FIG. 3, the interlock member plays an important role from a structural standpoint as well as performing the function of restricting axial movement of tie bars 68 and 70 by way of engagement of locking notches (such as locking notch 84 of tie bar 68). Of course the joining of channel 82 with upper portion 86 of span bar 64 can be accomplished in a manner similar to that described above with respect to FIG. 2.

Figure 4:
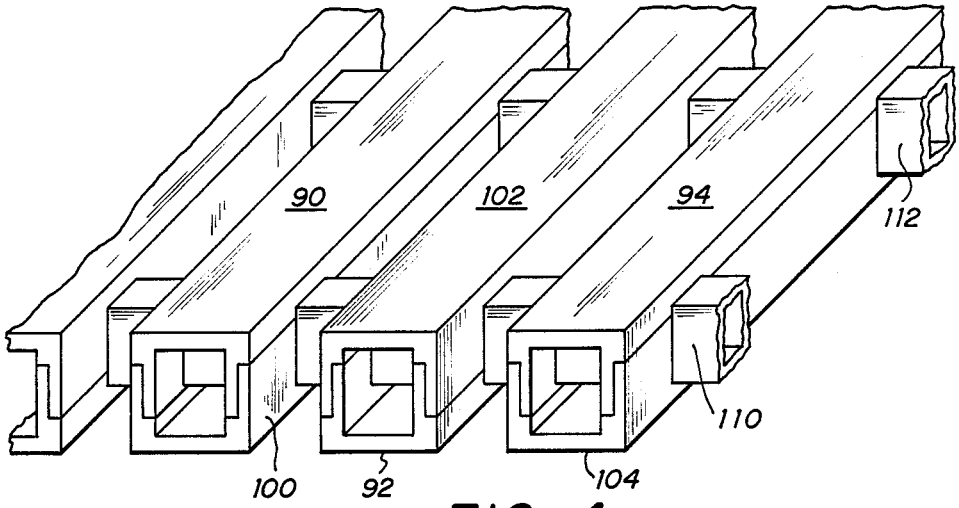
FIG. 4 is a perspective view of a third embodiment of a grate structure of the present invention shown in an assembled mode.
Figure 5:
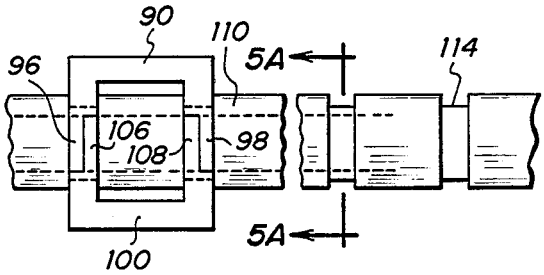
FIG. 5 is an end view of the span bar-tie bar intersection of the grate structure of FIG. 4.
Figure 5A:
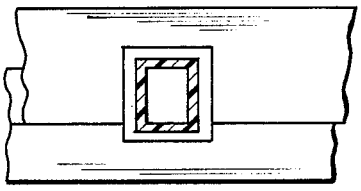
FIG. 5*a* is a side view of the intersection shown in FIG. 5.

FIG. 4 depicts a third embodiment of the grate structure of the present invention wherein the span bar and interlock members are of generally a U-shape and form a load bearing member of substantially square cross-section. Thus, as shown in FIG. 4, span bars 90, 92 and 94 are similar in cross-sectional configuration to interlock members 100, 102 and 104 and join together to lock in place tie bar members 110 and 112. Referring to FIG. 5, an end view of the grate structure depicted in FIG. 4 is shown in order to illustrate the junction of tie bar and the span bar. Thus, span bar 90 having engagement flanges 96 and 98 and interlock member 100 having engagement flanges 106 and 108, are shown bonded or welded together. Tie bar 110 is fabricated with locking grooves such as locking groove 114 shown in FIG. 5 and 5*a*. The locking grooves on the tie bar members are spaced apart such that the engagement flanges of span bar and interlock members will fit therein thus restricting axial movement of the tie bars. It is also noted that because the locking groove engages both the span bar and the longitudinal interlock member, relative longitudinal slippage between span bar and longitudinal lock member, which might be induced by deformation of the grating article under load, is restricted. Thus, in this embodiment the three pieces of the grate system interact to restrict both axial movement of the tie bar and relative longitudinal slip between the span bar and interlock member thus providing a mechanically interlocked three-piece system.

Figure 6:
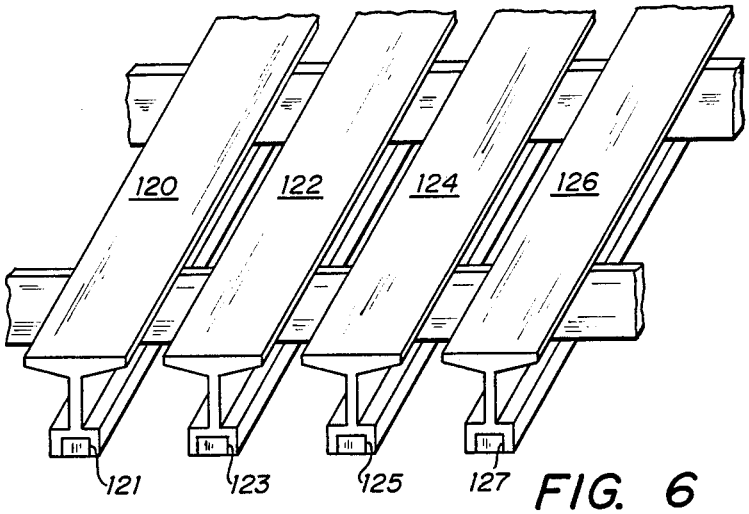
FIG. 6 is a perspective view of another embodiment of the grate structure of the present invention.
Figure 7:
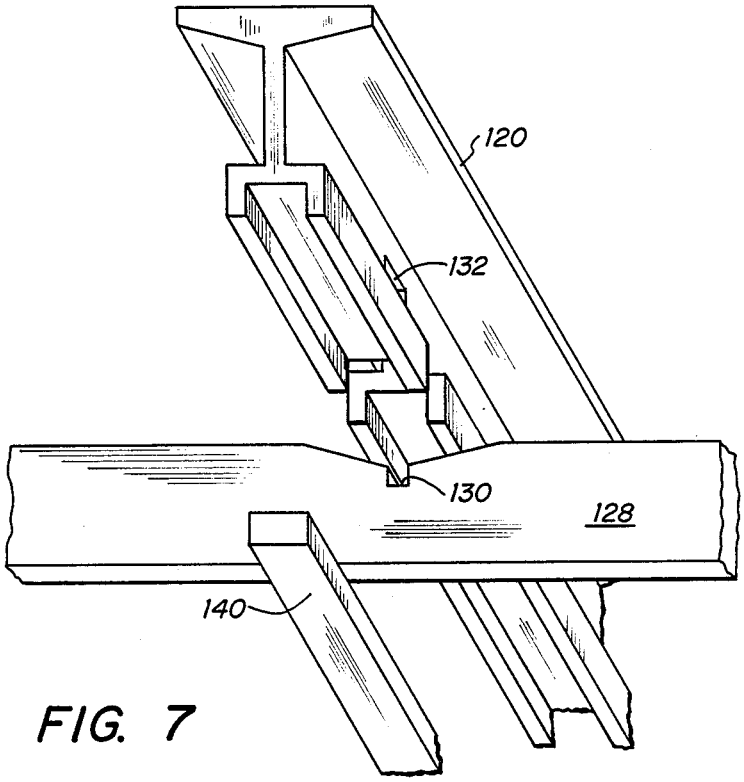
FIG. 7 is a blown apart perspective view of yet another embodiment of the grate structure showing, in particular, the three pieces and the alignment for their assembly at the span bar-tie bar intersection.

Referring to FIG. 6, a fourth embodiment of the grate system of the present invention is depicted. In this embodiment longitudinal span bars 120, 122, 124 and 126 are of a modified T cross-section having locking channels 121, 123, 125 and 127 integrally formed at the lower ends thereof. As best shown in FIG. 7 which is an exploded perspective view of a section of the grate system in FIG. 6, tie bar 128 comprises a locking notch 130 which engages the portion of span bar 120 just above lateral locating slot 132. Additional structural integrity is provided by sloping the upper surfaces of tie bar 128 toward locking notch 130 so that the configuration thereof matches the slope of the top portion of the modified T cross-section of span bar 120. In this embodiment, interlock member 140 while providing some structural support to the structure mainly acts (once bonded or welded in place) to hold the locking notch 130 in locked engagement within its position within lateral slot 132 thereby locking the position of tie bar 128 with respect to span bar 120.

From the above description of some of the preferred embodiments of the grate structure of the present invention, other modifications and alterations will now be apparent to those skilled in the art. All such modifications and alterations which fall within the scope of the appended claims are intended to be covered thereby.

I claim:

1. A load bearing grate structure comprising: longitudinal span bars having top and bottom surfaces and having lateral locating slots spaced therealong, said lateral locating slots having a generally U-shaped configuration;

transverse tie bars having top and bottom surfaces, said top surfaces having axial locking slots spaced therealong and said bottom surfaces being arcuate for mating with said lateral locating slots of said longitudinal span bars;

longitudinal interlock members having top and bottom surfaces, said top surfaces being flat for receiving the load and said bottom surfaces including a channel; and said channel being defined by sidewalls and being disposed for receiving said top surfaces of said longitudinal span bars between said channel side walls along length thereof and for engaging said axial locking slots of said transverse tie bars on the outside of said sidewalls to form a unitary load bearing structure.

2. The grate structure of claim 1 wherein said longitudinal interlock members are chemically bonded to said longitudinal span bars.

3. The structure of claim 1 wherein said longitudinal span bars have a substantially T cross-sectional configuration.

4. The grate structure of claim 1 wherein said longitudinal span bars and said longitudinal interlock members combine to form a load bearing member having a substantially "I" beam cross-sectional configuration.

* * * * *